US006646853B2

(12) United States Patent
Jacobs et al.

(10) Patent No.: US 6,646,853 B2
(45) Date of Patent: Nov. 11, 2003

(54) CURRENT CONTROL OF A POWER SUPPLY FOR AN IONIZER

(75) Inventors: Michael A. Jacobs, Lansdale, PA (US); Ken S. Foo, Lansdale, PA (US)

(73) Assignee: Illinois Tool Works Inc., Glenview, IL (US)

( * ) Notice: Subject to any disclaimer, the term of this patent is extended or adjusted under 35 U.S.C. 154(b) by 25 days.

(21) Appl. No.: 09/998,584

(22) Filed: Nov. 16, 2001

(65) Prior Publication Data

US 2003/0043529 A1 Mar. 6, 2003

Related U.S. Application Data

(60) Provisional application No. 60/316,757, filed on Sep. 4, 2001.

(51) Int. Cl.[7] ..... H05F 3/06
(52) U.S. Cl. ..... 361/212
(58) Field of Search ..... 361/212, 213, 361/220, 225, 230, 235

(56) References Cited

U.S. PATENT DOCUMENTS 4,809,127 A 2/1989 Steinmann et al.
5,930,105 A 7/1999 Pitel et al.
6,259,591 B1 7/2001 Pitel et al.

*Primary Examiner*—Gregory J. Toatley, Jr.
*Assistant Examiner*—Boris Benenson
(74) *Attorney, Agent, or Firm*—Akin, Gump, Strauss, Hauer & Feld, L.L.P.

(57) ABSTRACT

A control circuit for an ionizer controls an output of at least one of a positive voltage direct current (DC) power supply (PS) and a negative voltage DC PS. Each PS is connected to at least one ionizing pin. The control circuit controls the output of the power supplies so as to cause a flow of positive and negative ions from the ionizer and directed towards a target. The control circuit includes a positive PS return current sense resistor that biases the negative voltage PS to decrease the output of the negative voltage PS when the current detected by the positive sense resistor increases and to increase the output of the negative voltage PS when the current detected by the positive sense resistor decreases. The control circuit includes a similar negative PS return current sense resistor and associated bias circuitry for controlling the negative voltage power supply.

8 Claims, 16 Drawing Sheets

CURRENT CONTROL OF A POWER SUPPLY FOR AN IONIZER

CROSS-REFERENCE TO RELATED APPLICATIONS

This application claims the benefit of U.S. Provisional Application No. 60/316,757, filed Sep. 4, 2001, entitled "Current Control Of A Power Supply for an Ionizer."

BACKGROUND OF THE INVENTION

Controlling static charge is an important issue in continuous web operations (product moved in a continuous or nearly continuous feed) and in semiconductor manufacturing. Undesirable Triboelectric (static caused by friction) charges are introduced onto the web during handling by rollers, cutters and the like. In web operations, such undesirable charges can attract unwanted particulate matter onto the product, can cause difficult handling issues with the product, and may even cause discharges which are potentially harmful to the electronic controls that operate the machines. In semiconductor manufacturing, device defects caused by electrostatically attracted foreign matter and electrostatic discharge events contribute greatly to overall manufacturing losses.

Air ionization is an effective method of eliminating static charges on non-conductive materials and isolated conductors. Air ionizers generate large quantities of positive and negative ions in the surrounding atmosphere which serve as mobile carriers of charge in the air. As ions flow through the air, they are attracted to oppositely charged particles and surfaces. Neutralization of electrostatically charged surfaces can be rapidly achieved through this process.

Air ionization may be performed using electrical ionizers which generate ions in a process known as corona discharge. Electrical ionizers generate air ions through this process by intensifying an electric field around a sharp point until it overcomes the dielectric strength of the surrounding air. Negative corona occurs when electrons are flowing from the electrode into the surrounding air. Positive corona occurs as a result of the flow of electrons from the air molecules into the electrode.

Ionizer devices take many forms such as ionizing bars, air ionization blowers, air ionization nozzles, and the like, and are utilized to neutralize static electrical charge by emitting positive and negative ions into the workspace or onto the surface of an area carrying undesirable static charges. Ionizing bars are typically used in continuous web operations such as paper printing, polymeric sheet material, or plastic bag fabrication. Air ionization blower and nozzles are typically used in workspaces for assembling electronics equipment such as hard disk drives, integrated circuits, and the like, that are sensitive to electrostatic discharge (ESD).

To achieve the maximum possible reduction in static charges from an ionizer of a given output, the ionizer must produce amounts of positive and negative ions in order to compensate for the net charge on the web or in the workspace. That is, the output of the ionizer must increase or decrease the output of positive and/or negative ions in order to achieve a neutralized net charge on the web or in the workspace.

One prior art method of generating ions is by use of an alternating current (AC) voltage generator connected to ionizing pins which produces ions of one polarity for approximately 35% of a half cycle and then, after a delay, produces ions of the other polarity for approximately 35% of a half cycle. The positive ions and negative ions are output based upon the cycle or frequency of the AC voltage waveform and are not controlled based upon feedback of the actual charge on the web or in the workspace or on the demand for ions of a particular polarity. Such prior art devices are discussed in U.S. Pat. No. 3,936,698 (Meyer) and U.S. Pat. No. 3,714,531 (Takahashi). The drawback to AC ionizers is that when the net charge is negative on the web or in the workspace is negative, negative ions are still going to be generated and possibly directed onto the web or into the workspace, which will have no effect in neutralizing the negative charge. The converse is also true when the net charge is positive. Additionally, there is a lag time between generating positive ions and negative ions directly related to the rise time of the AC voltage waveform. Thus, ions are produced in slugs rather than in a continuous manner which further is not effective in neutralizing a charge in applications with a fast moving web.

Another prior art method for generating ions is by use of a high voltage direct (DC) current generator of each polarity connected to ionizing pins. Some of these DC generators are merely fixed output power supplies that generate a continuos output of both positive and negative ions. A user may take readings with a handheld charge monitor and then make adjustments to the positive or negative power supply accordingly. However, the change in charge on the web or the workspace can occur very quickly and very frequently. Simple changes to the ambient conditions such as temperature, humidity, and the like, can have a drastic affect on the Triboelectric charging that the materials being handled experience. Thus, it is not possible for a user to make adjustments often enough (continuously) to compensate for the charge fluctuations.

One prior art device described in U.S. Pat. No. 5,930,105 describes a control circuit for a DC ionizer that attempts to trim the outputs of the positive and negative power supplies by monitoring the total net current through a resistor that purportedly corresponds to a change in the charge value. The single return current sensing resistor compensates the outputs of both power supplies, and does not separately control them. Thus, there is always a given output level of each type of ion, positive and negative, which does not compensate for charge changes quickly enough, especially in a fast-moving web. This DC ionizer only produces slightly more of one ion over the other and therefore the net charge that reaches the web or workspace has little affect when the charge on the web or workspace changes quickly.

Accordingly, there is an unmet need for a controller for a DC ionization system which allows for fast response time and achieves improved charge neutralization. The present invention fulfills these needs.

BRIEF SUMMARY OF THE INVENTION

The present invention provides a control circuit for an ionizer which controls an output of at least one of a positive voltage direct current power supply and a negative voltage direct current power supply. Each power supply is connected to at least one ionizing pin. The control circuit controls the output of at least one of the power supplies so as to cause a flow of positive and negative ions to be emitted from the ionizer and directed towards a target. The control circuit includes a positive power supply return current sense resistor that biases the positive voltage power supply to increase the output of the positive voltage power supply when a positive ion current detected by the positive power supply return current sense resistor decreases and to decrease the output of the positive voltage power supply when the positive ion current detected by the positive power supply return current sense resistor increases, thereby creating a static-free environment at the target. The control circuit also includes a negative power supply return current sense resistor that biases the negative voltage power supply to decrease the output of the negative voltage power supply when a negative ion current detected by the negative power supply return current sense resistor increases and to decrease the output of the negative voltage power supply when the negative ion current detected by the negative power supply return current sense resistor increases, thereby creating the static-free environment at the target.

In an alternate embodiment, the positive power supply return current sense resistor biases the negative voltage power supply to decrease the output of the negative voltage power supply when a positive ion current detected by the positive power supply return current sense resistor increases and to increase the output of the negative voltage power supply when the positive ion current detected by the positive power supply return current sense resistor decreases, thereby creating the static-free environment at the target. The negative power supply return current sense resistor biases the positive voltage power supply to decrease the output of the positive voltage power supply when a negative ion current detected by the negative power supply return current sense resistor increases and to increase the output of the positive voltage power supply when the negative ion current detected by the negative power supply return current sense resistor decreases, thereby creating the static-free environment at the target.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

I. Overview

Figure 1:
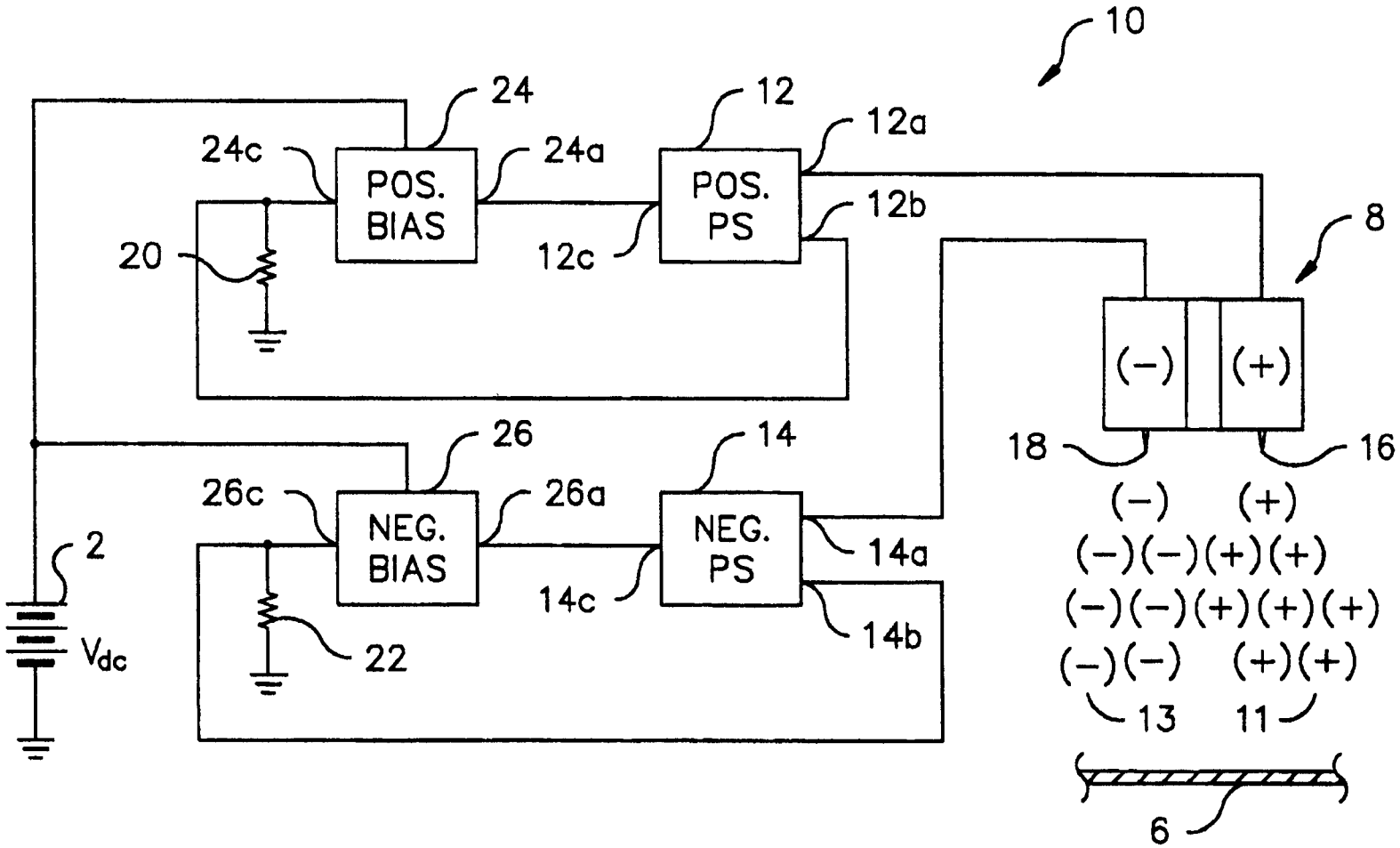
FIG. 1 is a simplified electrical schematic of a control circuit in accordance with a second embodiment of the present invention.
Figure 2:
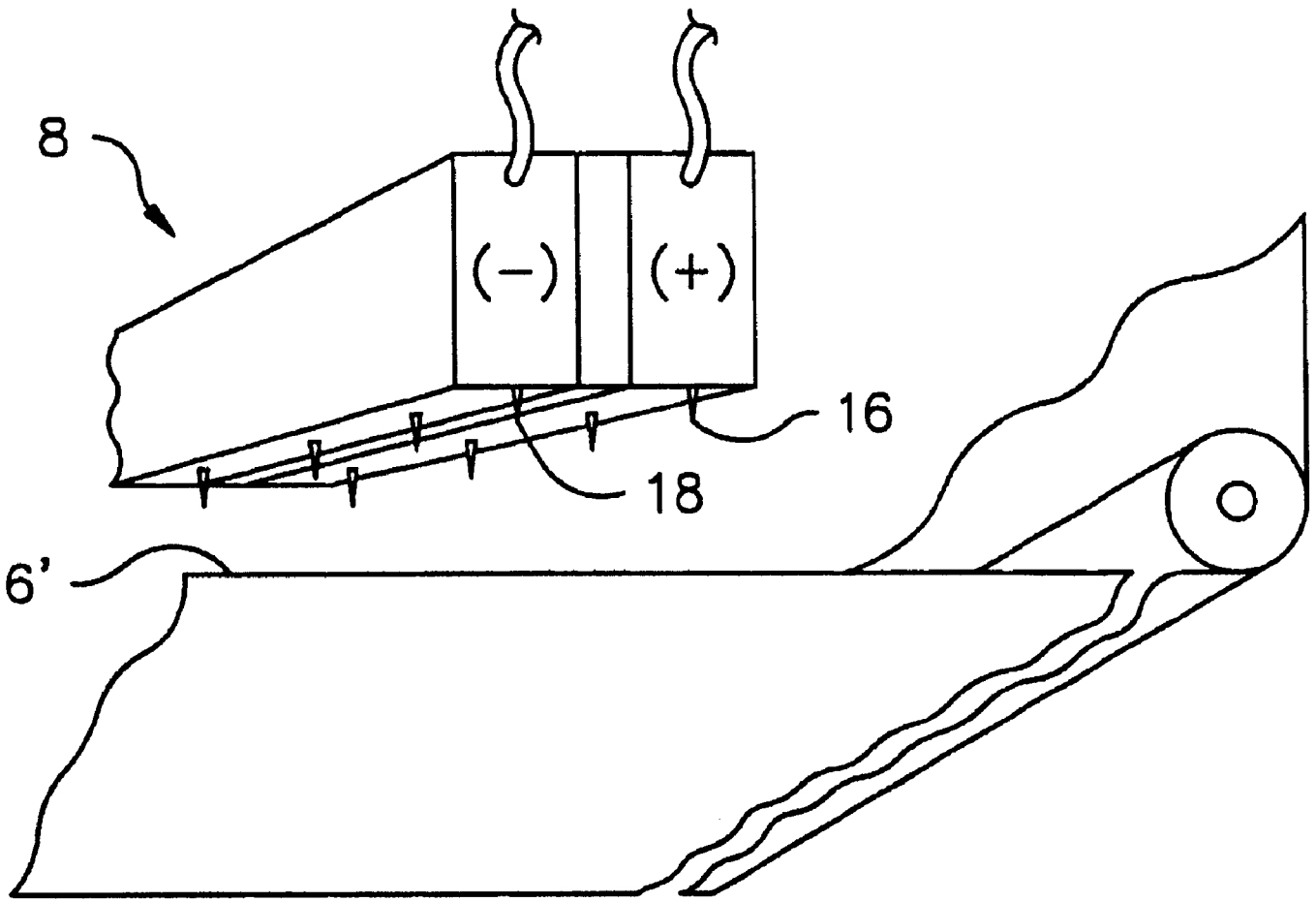
FIG. 2 is a perspective view of an ionizer mounted above a moving web.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of any device described and designated parts thereof. The terminology includes the words above specifically mentioned, derivatives thereof and words of similar import. Additionally, the word "a" is used in the claims and in the corresponding portions of the specification, means "at least one."

Referring now to the drawings in detail, wherein like numerals indicate like elements throughout, FIGS. 4, 9A–9C and 10–15 show a preferred embodiment of a control circuit in accordance with the present invention. FIGS. 1, 3 and 5–8 show alternate embodiments of a control circuit in accordance with the present invention.

FIG. 1 shows a control circuit 10 for an ionizer 8 which controls an output 12*a* of a positive voltage direct current (DC) power supply 12 and an output 14*a* of a negative voltage DC power supply 14. Each power supply, positive and negative voltage, is connected to at least one ionizing pin 16, 18, respectively. The control circuit 10 controls the output 12*a* or 14*a*, of at least one of the power supplies 12, 14 so as to cause a flow of positive 11 and negative 13 ions to be emitted from the ionizer 8 and directed towards a target 6. The target 6, as used herein, may be a continuous web product like paper, plastic, or the like, or the target 6 may simply be a general workspace or area. The control circuit 10 includes a positive power supply return current sense resistor 20. The positive power supply return current sense resistor 20 provides a voltage drop based upon the current through the positive voltage power supply 12, and the voltage drop across the positive power supply return current sense resistor 20 is an input 24*c* of a positive bias circuit 24. An output 24*a* of the positive bias circuit 24 biases the positive voltage power supply 12 by modulating a low voltage DC source 2 to an input 12*c* of the positive voltage power supply 12 in order to increase the output 12*a* of the positive voltage power supply 12 when a negative ion current detected by the positive power supply return current sense resistor 20 decreases and to decrease the output 12*a* of the positive voltage power supply 12 when the positive ion current detected by the positive power supply return current sense resistor 20 increases, thereby creating a static-free environment at the target 6. The low voltage DC source 2 is between about 12 Volts DC and about 24 Volts DC, but is preferably about 16.5 Volts DC. The control circuit 10 also includes a negative power supply return current sense resistor 22. The negative power supply return current sense resistor 22 provides a voltage drop based upon the current through the negative voltage power supply 14, and the voltage drop across the negative power supply return current sense resistor 22 is an input 26*c* of a negative bias circuit 26. An output 26*a* of the negative bias circuit 26 biases the negative voltage power supply 14 by modulating the low voltage DC source 2 an input 14*c* of the negative voltage power supply 14 in order to increase the output 14*a* of the negative voltage power supply 14 when a negative ion current detected by the negative power supply return current sense resistor 22 decreases and to decrease the output 14*a* of the negative voltage power supply 14 when the negative ion current detected by the negative power supply return current sense resistor 22 decreases, thereby creating the static-free environment at the target 6. The control circuit 10 is designed to maintain a constant current.

The control circuit 10 illustrated in FIG. 1 is operating in a current control mode. When no charge is present on the target 6, the control circuit 10 automatically adjusts the amount of positive 11 and negative 13 ions to produce a cloud (not shown) of balanced charge above the target 6. When a net negative charge (not shown) appears on the target 6, an imbalance occurs in the cloud as positive ions 11 are depleted and are attracted to the negative charge on the target 6. Since the control circuit 10 is designed to maintain a constant current, the positive bias circuit 24 increases the output 12*a* of the positive voltage power supply 12 which, in turn, produces more positive ions 11. Since there is no positive charge on the target 6, the negative bias circuit 26 will decrease the output 14*a* of the negative voltage power supply 14 which, in turn, produces less negative ions 13. The converse is also true. The current control mode is better suited for applications where the ionizer 8 is located relatively close, approximately ½" to 3", to the target 6 and when the target is not moving or is moving relatively slowly.

Figure 3:
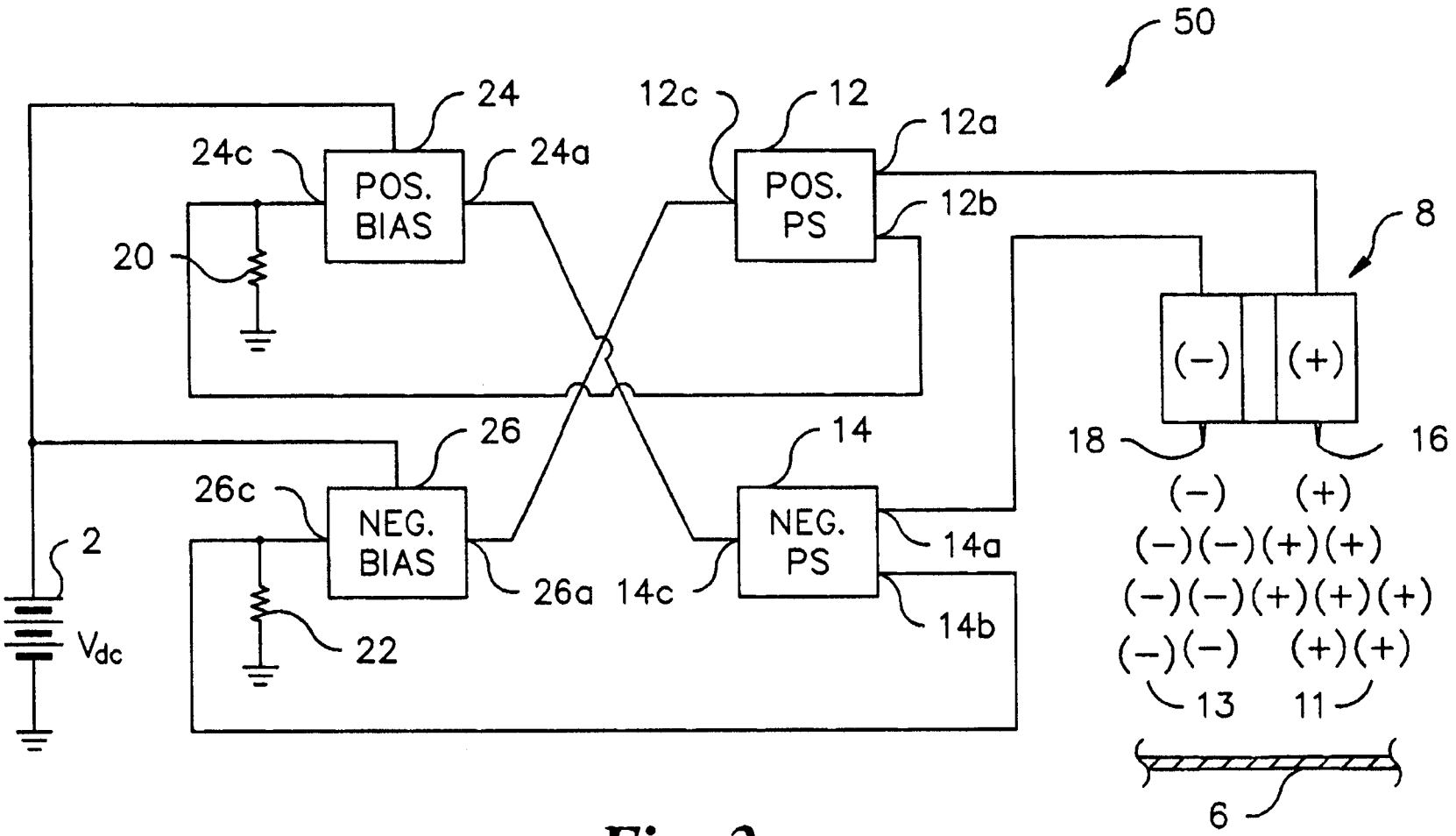
FIG. 3 is a simplified electrical schematic of a third embodiment of a control circuit in accordance with the present invention.
Figure 6:
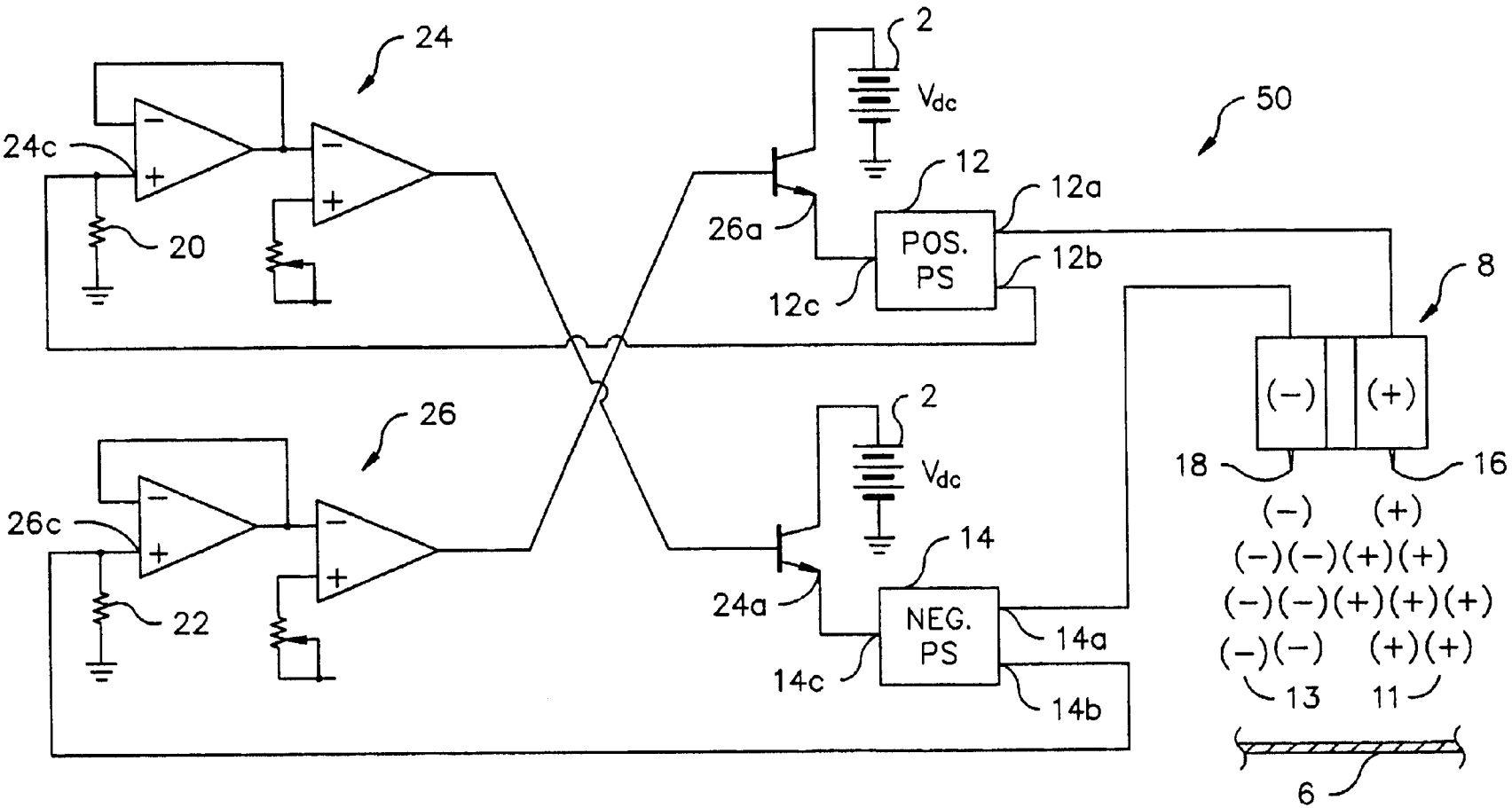
FIG. 6 is a detailed electrical schematic of the control circuit of FIG. 3.

FIGS. 3 and 6 show a second embodiment of the cross control circuit 50. The positive power supply return current sense resistor 20 biases the negative voltage power supply 14 to decrease the output 14*a* of the negative voltage power supply 14 when the positive ion current detected by the positive power supply return current sense resistor 20 increases and to increase the output 14*a* of the negative voltage power supply 14 when the positive ion current detected by the positive power supply return current sense resistor 20 decreases, thereby creating the static-free environment at the target. The negative power supply return current sense resistor 22 biases the positive voltage power supply 12 to decrease the output 12*a* of the positive voltage power supply 12 when a negative ion current detected by the negative power supply return current sense resistor 22 increases and to increase the output 12*a* of the positive voltage power supply 12 when the negative ion current detected by the negative power supply return current sense resistor 22 decreases, thereby creating the static-free environment at the target.

The cross control circuit 50 illustrated in FIG. 3 is operating in a cross control mode. When no charge is present on the target 6, the cross control circuit 50 automatically adjusts the amount of positive 11 and negative 13 ions to produce a cloud (not shown) of balanced charge above the target 6. When a net negative charge appears on the target 6, an imbalance occurs in the cloud as positive ions 11 are depleted and are attracted to the negative charge on the target 6. Since the control circuit is designed to maintain a constant current, the positive bias circuit 24 decreases the output 14*a* of the negative voltage power supply 14 which, in turn, produces less negative ions 13. Since there is no positive charge on the target 6, the negative bias circuit 26 will increase the output 12*a* of the negative positive power supply 12 which, in turn, produces more positive ions 11. The converse is also true. The cross control mode is better suited for applications where the ionizer 8 is located relatively far, approximately 3"–12" or more, from the target 6 and when the target is moving relatively quickly.

Figure 4:
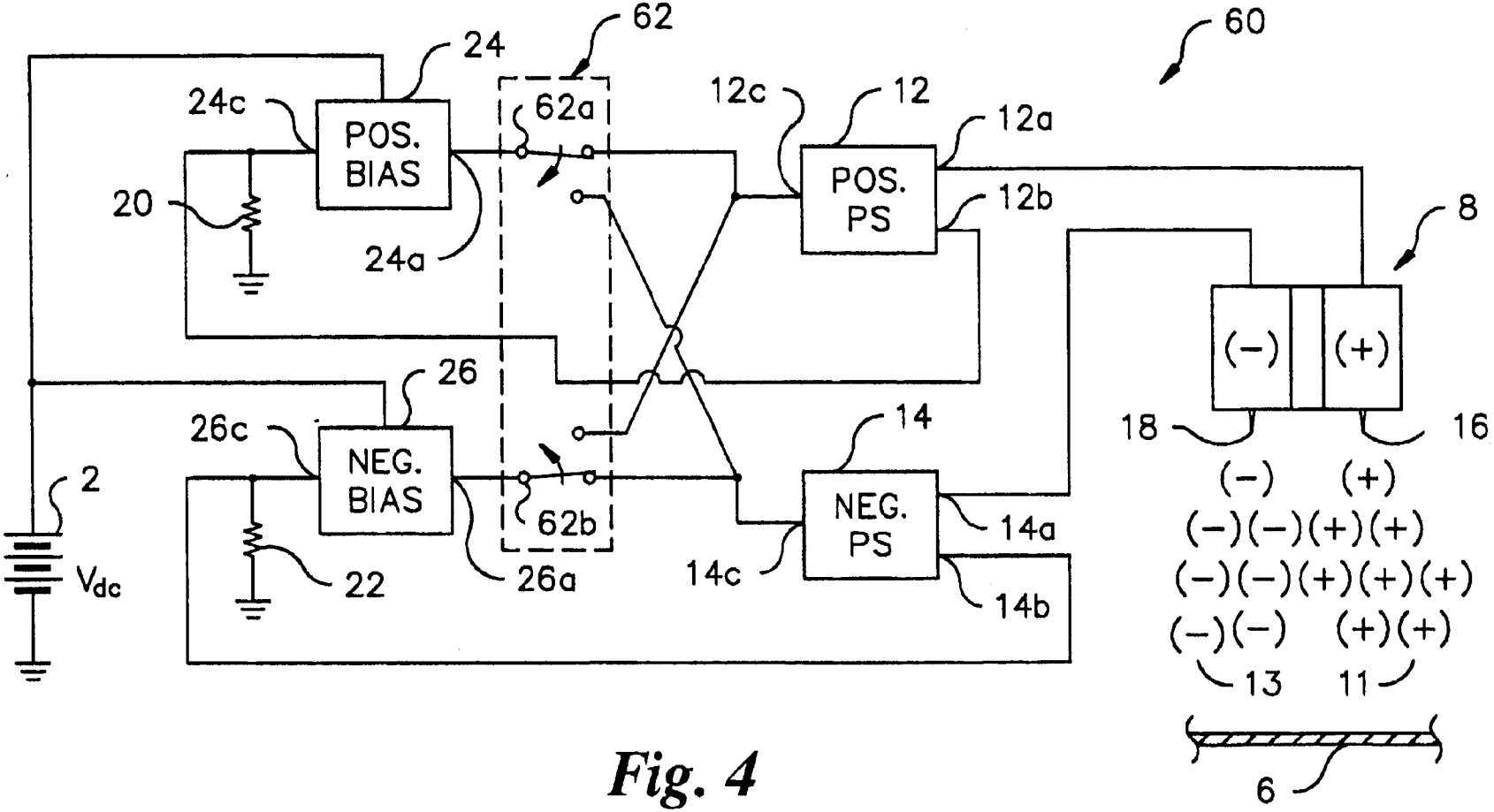
FIG. 4 is a simplified electrical schematic of a preferred embodiment of a control circuit in accordance with the present invention.
Figure 5:
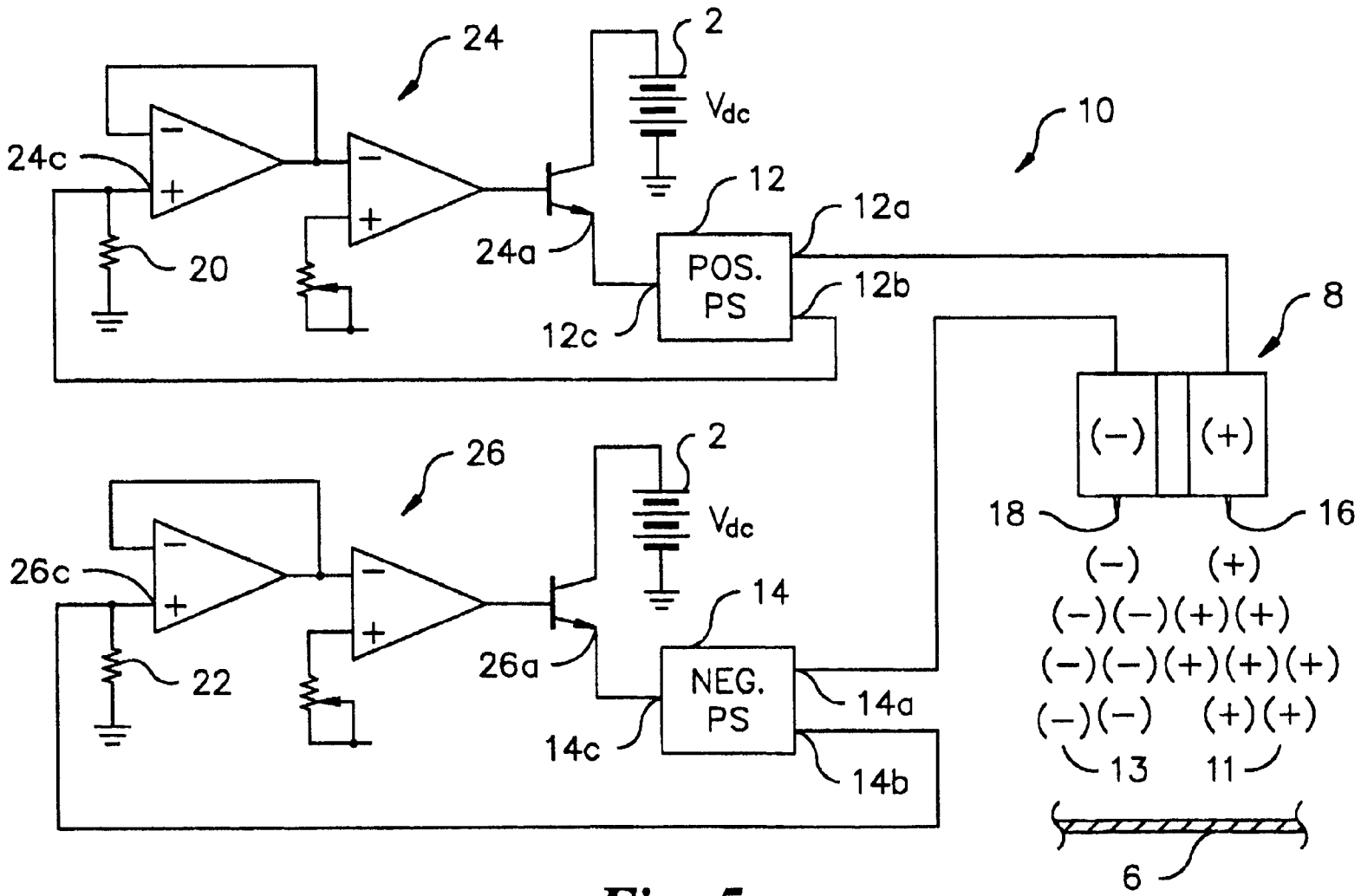
FIG. 5 is a detailed electrical schematic of the control circuit of FIG. 1.

FIG. 4 illustrates a preferred embodiment of a control circuit 60 in accordance with the present invention. The control circuit 60 includes a control mode selector switch 62 that has a first contact 62*a* and a second contact 62*b*. The control mode selector switch 62 has a first position and a second position. The first position is associated with the current control mode and the second position is associated with the cross control mode. When the control mode selector switch 62 is in the first position, the output 24*a* of the positive bias circuit 24 is directed through the first contact 62*a* to the input 12*c* of the positive voltage power supply 12 and the output 26*a* of the negative bias circuit 26 is directed through the second contact 62*b* to the input 14*c* of the negative voltage power supply 14. Thus, when the control mode selector switch 62 is in the first position, the control circuit 60 operates substantially the same as the control circuit 10 shown in FIGS. 1 and 5. Alternatively, when the control mode selector switch 62 is in a second position, the output 24*a* of the positive bias circuit 24 is directed through the first contact 62*a* to the input 14*c* of the negative voltage power supply 14 and the output 26*a* of the negative bias circuit 26 is directed through the second contact 62*b* to the input 12*c* of the positive voltage power supply. Thus, when the control mode selector switch 62 is in the second position, the control circuit 60 operates substantially the same as the cross control circuit 50 shown in FIGS. 3 and 6. The mode selector switch 62 may be a simple two position, dry contact type switch with a slide-type actuator, a rotary type actuator, push-to-set/push-to-reset actuator, or a toggle type actuator. Alternatively, the mode selector switch may simply pilot a relay, silicon controlled rectifier (SCR), transistor, or the like, to divert the two outputs. The type of switch or its equivalent is not critical to the present invention, and therefore is not discussed in greater detail herein.

In the present embodiment, the user may determine that the ionizer 8 has to be mounted nearer to or farther from the target 6 or may relocate the ionizer 8 to another location. The mode selector switch 62 enables the user to easily select the best mode, current control or cross control, based upon the mounting location and target conditions as described above.

Figure 7:
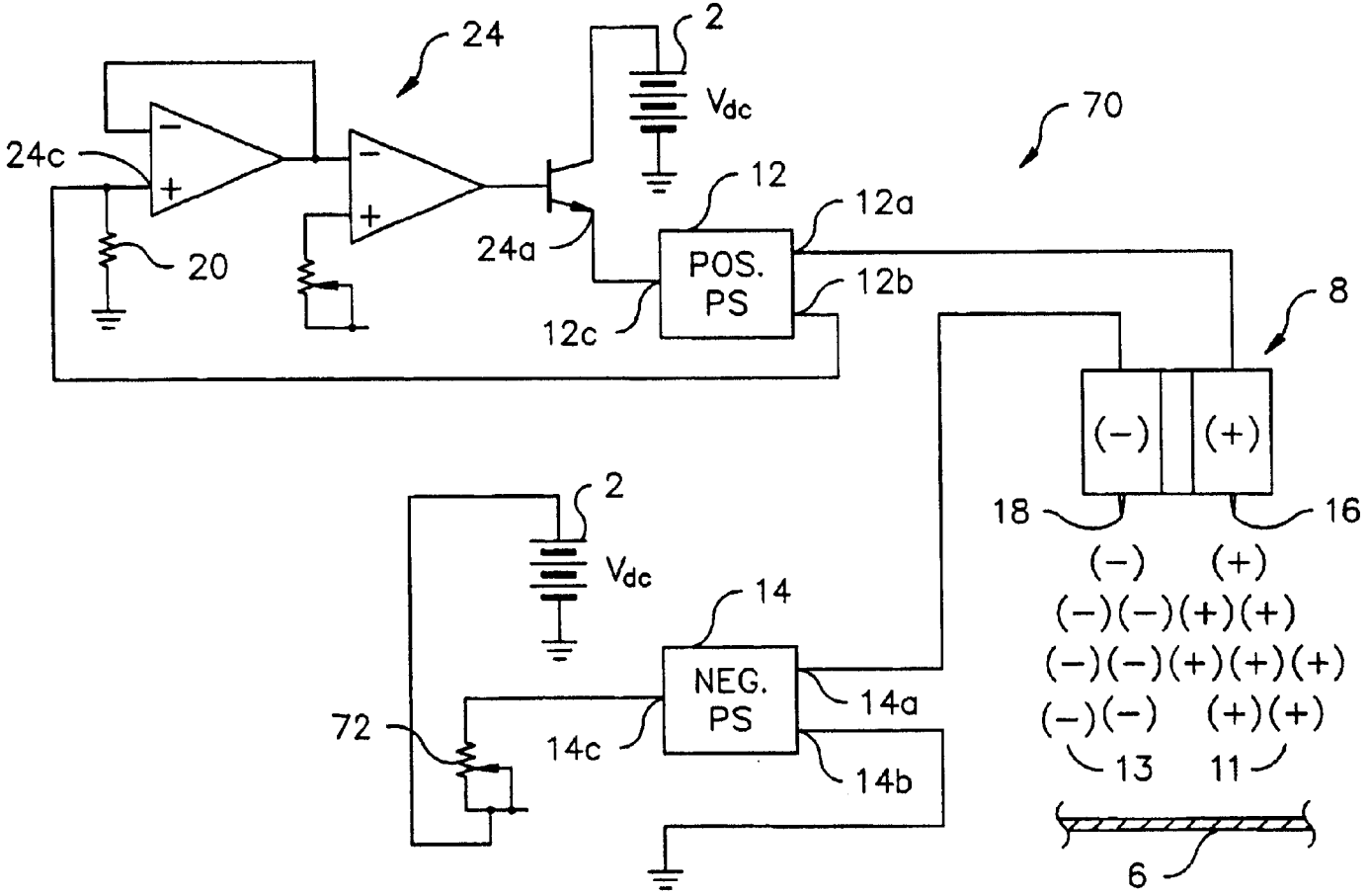
FIG. 7 is a detailed electrical schematic of a fourth embodiment of a control circuit in accordance with the present invention.

FIG. 7 illustrates a fourth embodiment of the present invention wherein only the positive voltage power supply is automatically controlled. A control circuit 70 includes all of the elements associated with the positive bias circuit 24, but does not include the negative bias circuit 26 or its associated negative power supply return current sense resistor 22. The control circuit 70 may or may not include a user adjustable control device 72, such as a potentiometer or the like, for manually adjusting the output 14*a* level of the negative voltage power supply 14. Alternatively, the negative voltage power supply 14 may be selected with a fixed or nonadjustable constant voltage output 14*a*. In an alternate of this embodiment, the positive voltage power 12 is manually adjusted and the positive bias circuit 24 adjusts the negative voltage power supply 14.

Figure 8:
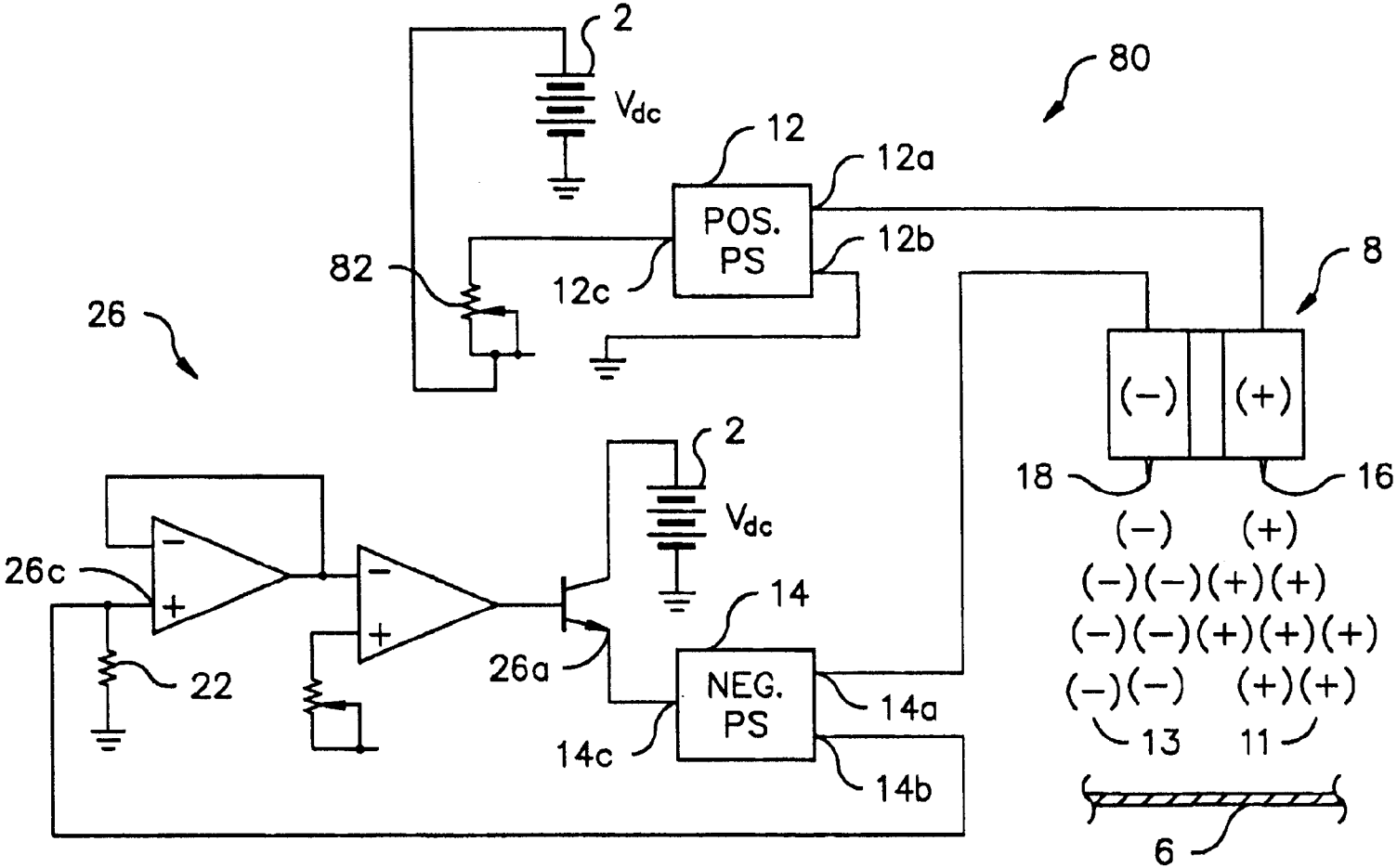
FIG. 8 is a detailed electrical schematic of a fifth embodiment of a control circuit in accordance with the present invention.
Figure 9A:
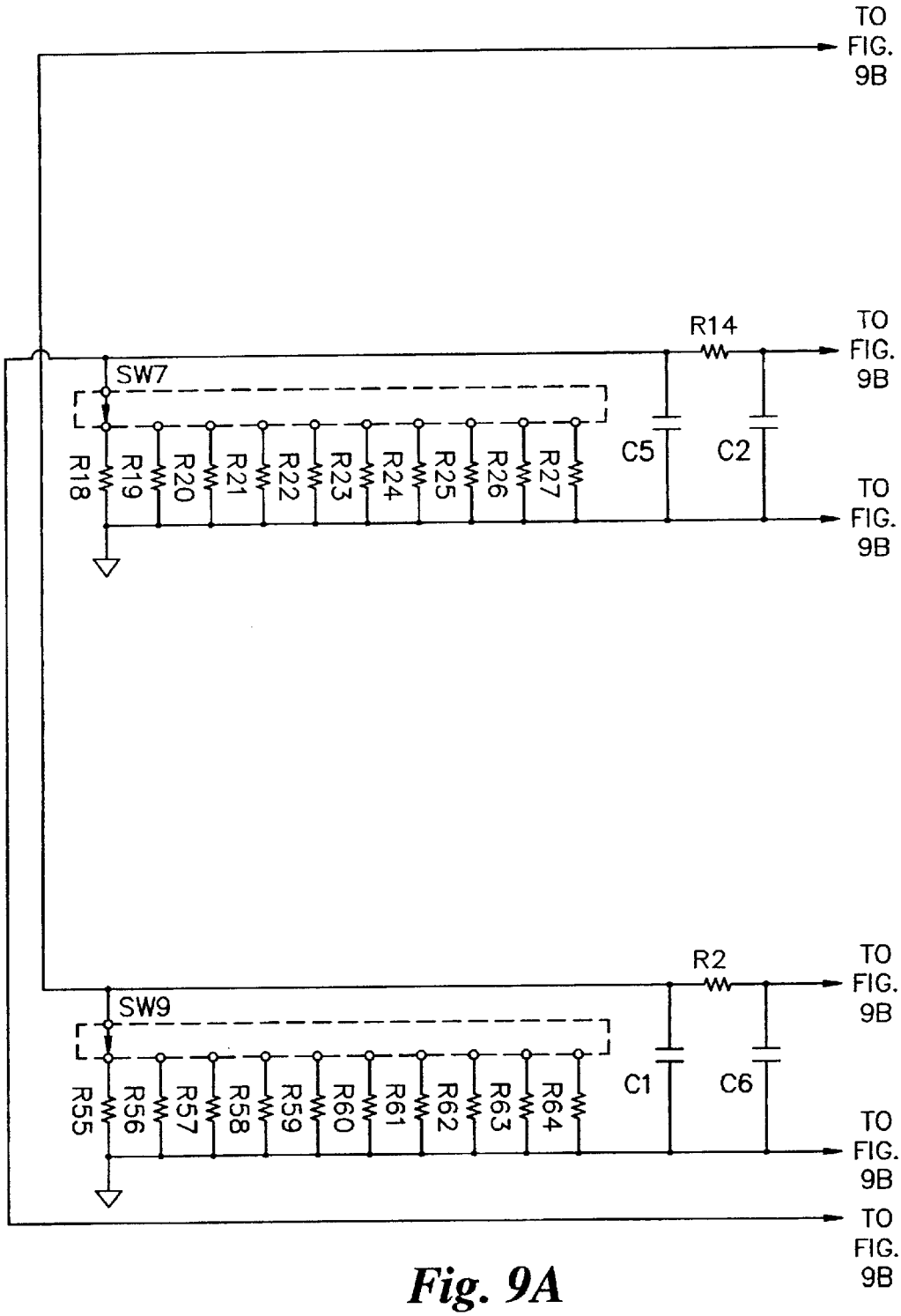
FIGS. 9A–9C, taken together, show a detailed electrical schematic of the control circuit of FIG. 4.
Figure 9B:
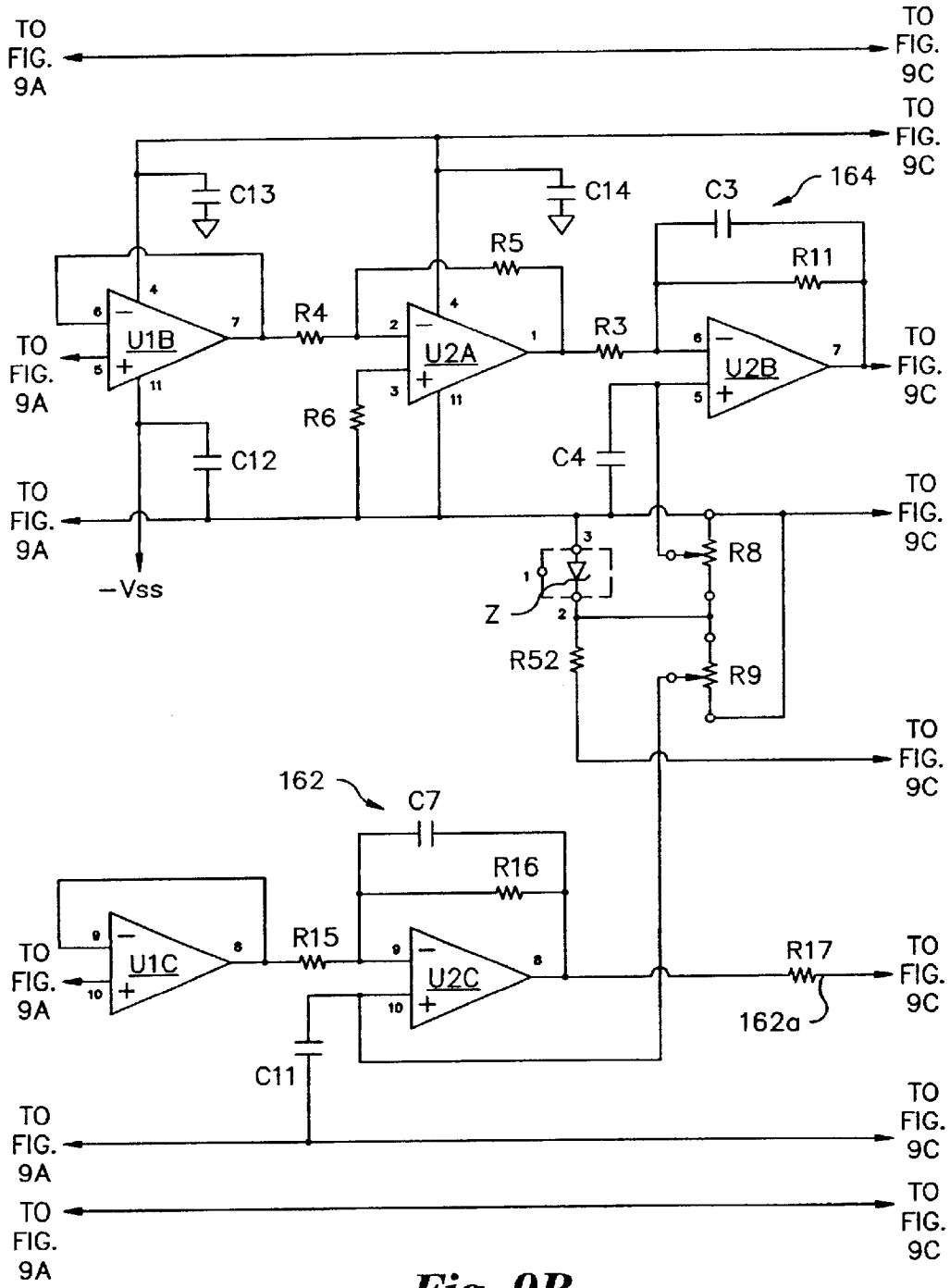
Figure 9C:
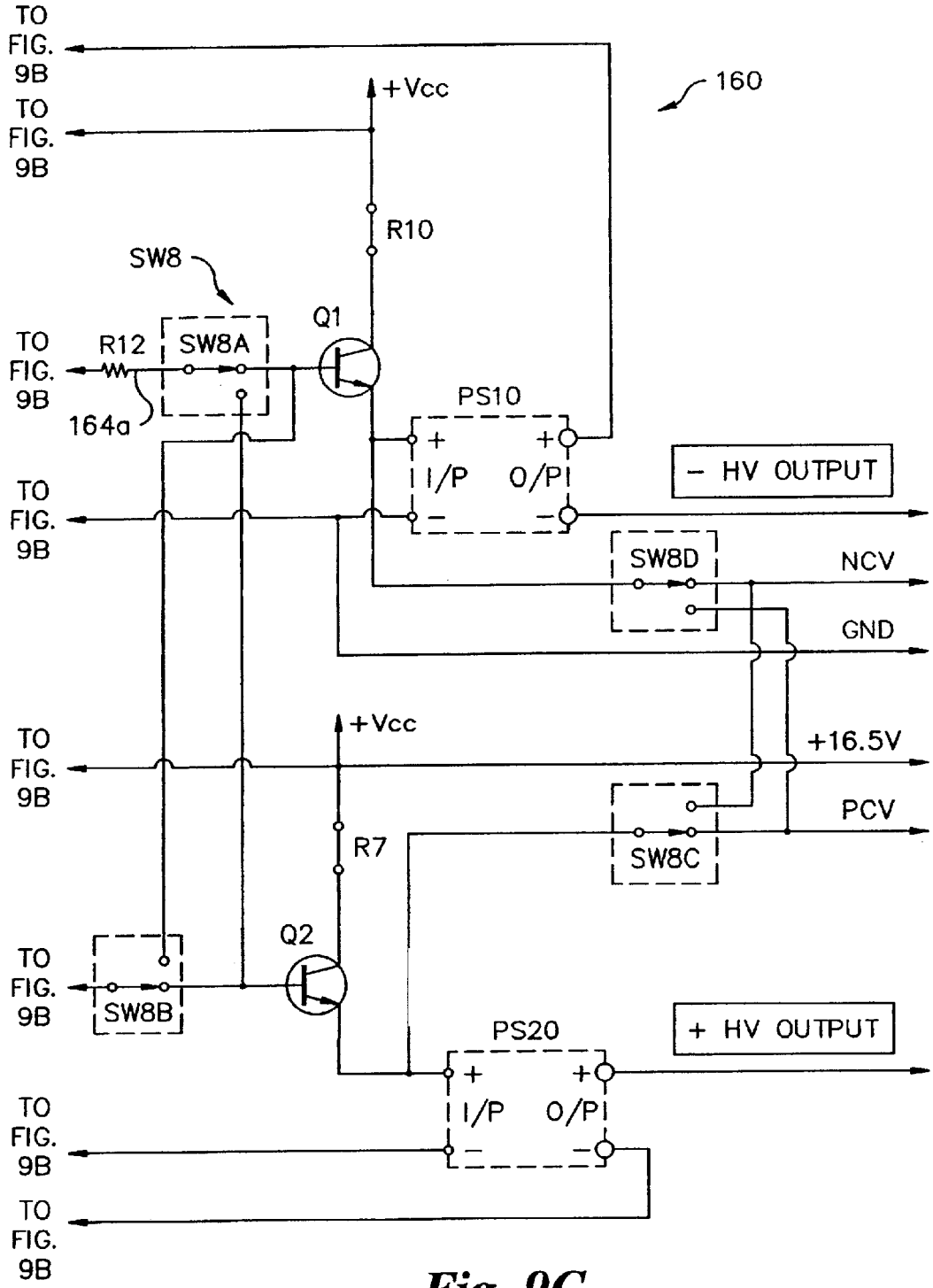

FIG. 8 illustrates a fifth embodiment of the present invention wherein only the negative voltage power supply is automatically controlled. A control circuit 80 includes all of the elements associated with the negative bias circuit 26, but does not include the positive bias circuit 24 or its associated positive power supply return current sense resistor 20. The control circuit 80 may or may not include a user adjustable control device 82, such as a potentiometer or the like, for manually adjusting the output 12*a* level of the positive voltage power supply 12. Alternatively, the positive voltage power supply 12 may be selected with a fixed or nonadjustable constant voltage output 12*a*. In an alternate of this embodiment, the negative voltage power 14 is manually adjusted and the negative bias circuit 26 adjusts the positive voltage power supply 12.

II. Detailed Description

Referring now to FIGS. 9A–9C and 10–15, a much more detailed version of the embodiment described above and demonstrated in FIG. 4 is provided. It should be noted that other components and devices may be utilized to implement the circuits describe hereafter without departing from the broad scope of the present invention.

Figure 10:
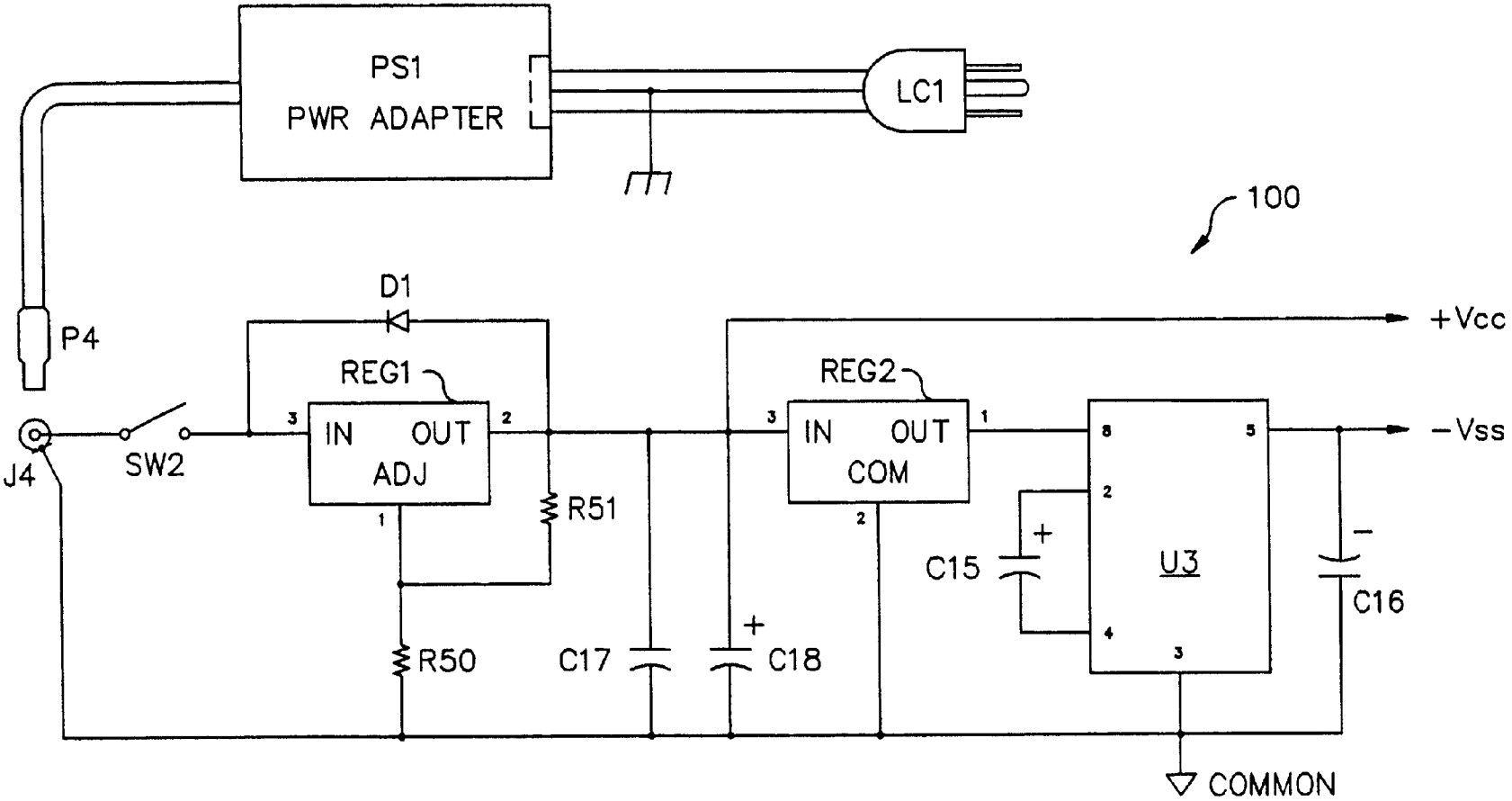
FIG. 10 is a detailed electrical schematic of a power supply for the control circuit of FIGS. 9A–9C.

FIG. 10 illustrates a power supply 100 for a control circuit 160. A power adapter PS1, as is known in the art, converts an alternating current (AC) voltage to a DC voltage. The AC voltage may be between about 90 Volts AC and 250 Volts AC at about 50 to 60 Hz. The converted DC voltage may be between about 15 Volts DC and about 24 Volts DC. The power adapter PS1 includes a plug LC1 for connection to a conventional wall receptacle and a plug P4 for connection to a socket J4 mounted in a housing (not shown) for the remainder of the power supply 100 circuitry and the control circuit 160. The socket J4 is connected to a power switch SW2, which may be any two condition switch as is known in the art, but is preferably a two position toggle actuated switch with a dry-contact closure.

The power switch SW2 allows DC power to be delivered to a first voltage regulator integrated circuit (IC) REG1, which in conjunction with appropriately selected biasing elements such as resistors R50, R51, capacitors C17, C18, and a diode D1, regulates the voltage to about 16.0 Volts DC to 17.0 Volts DC, but preferably 16.5 Volts DC. The voltage output of regulator REG1 (hereinafter "regulated 16.5 VDC") is connected through appropriate electrical connections such as routed copper strips, jumpers, wires, and the like to other circuits shown in FIGS. 9A–9C and 11–15. The regulated 16.5 VDC is depicted on the drawings as an upwardly directed arrow with a "+Vcc" designator. The regulated 16.5 VDC also provides input power to a second voltage regulator IC REG2. The second voltage regulator IC REG2 regulates the voltage to about 14.5 Volts DC to about 15.5 Volts DC, but preferably 15.0 Volts DC. The output of the second voltage regulator IC REG2 provides input power to an inverter IC U3, which in conjunction with appropriately selected biasing elements such as capacitors C15, C16, provides an inverted or negative of the regulated output voltage from the second voltage regulator IC REG2. The inverted voltage output of inverter IC U3 is preferably about −15 volts DC (hereinafter "regulated −15 VDC"). The voltage output inverter IC U3 is connected through appropriate electrical connections such as routed copper strips, jumpers, wires, and the like to other circuits shown in FIGS. 9A–9C and 11–15. The regulated −15 VDC is depicted on the drawings as an downwardly directed arrow with a "−Vss" designator.

FIGS. 9A–9C show a more detailed version of the control circuit 60 of FIG. 4 described above, designated in FIGS. 9A–9C as the control circuit 160. The control circuit 160 includes a positive high voltage (HV) power supply PS20 and a negative high voltage power supply PS10. The high voltage power supplies PS10, PS20 may be of the same type and are preferably linear power supplies that accept a modulated input voltage of between about 0 volts DC and about 18 volts DC, but preferably between about 1 volt DC and 12 volts DC. The HV power supplies PS10, PS20 convert the input voltage to a corresponding output voltage between about 0 volts DC and about 15,000 volts DC (15 kV DC), but preferably to an output voltage between about 0 volts DC and about 5,000 volts (5 kV DC). The negative output voltage of the HV power supply PS10 is designated as −HV OUTPUT and is connected by cable, wire, or the like to a negative ionizer bar (not shown). The positive output voltage of HV power supply PS20 is designated as +HV OUTPUT and is connected by cable, wire, or the like to a positive ionizer bar (not shown).

The control circuit 160 also includes a negative power supply return current sense resistor bank SW7 and a positive power supply return current sense resistor bank SW9. The resistor banks SW7, SW9 are ten position, dip switch selectable resistor banks with different resistance values for each dip switch setting. Depending on the total length of the negative and positive ionizer bars from about one half a foot to about twenty feet, but preferably between about one foot to about ten feet, a different resistance value is selected on the negative resistor bank SW7 and the positive resistor bank SW9. In most installations, the negative and positive ionizer bars will be identical in length, so the resistance values of the negative and positive resistance banks SW7, SW9 will be set to equivalent resistance values. The added length of the ionizer bars adds resistance to the circuit, and therefore, the resistor banks SW7, SW9 allow for an adjustable compensation for the varying resistance due to changes in length. In an alternative embodiment, the ion current sense resistor banks SW7, SW9 are potentiometers for adjusting the compensation due to changes in length.

The positive power supply return current sense resistor bank SW9 provides, in conjunction with appropriate biasing elements such as resistors R2, R15, and capacitors C1, C6, an input voltage to an operational amplifier (Op-Amp) IC U1C. The input voltage of the Op-Amp IC U1C is based upon the positive ion current flow as measured through the HV power supplies PS10, PS20. An output of the Op-Amp IC U1C drives another Op-Amp IC U2C. The Op-Amp IC U2C, in conjunction with appropriate biasing components such as resistor R16, R17, capacitors C7, C11 and potentiometer R9, form a positive error amplifier 162.

The negative power supply return current sense resistor bank SW7 provides, in conjunction with appropriate biasing elements such as resistors R4, R14 and capacitors C2, C5, C12, C13, an input voltage to an Op-Amp IC U1B. The input voltage of the Op-Amp IC U1B is based upon the negative ion current flow as measured through the HV power supplies PS10, PS20. An output of the Op-Amp IC U1B drives another Op-Amp IC U2A. The Op-Amp IC U2A, in conjunction with appropriate biasing components such as resistors R3, R5, R6 and a capacitor C14, provides an input voltage to an Op-Amp IC U2B. The Op-Amp IC U2B, in conjunction with appropriate biasing components such as resistor R11, R12, capacitors C3, C4 and potentiometer R8, form a negative error amplifier 164.

The control circuit 160 further includes a control mode selector switch SW8 which has a first contact SW8A, a second contact SW8B, a third contact SW8C and a fourth contact SW8D. The control mode selector switch SW8 has a first position and a second position. The first position is associated with the current control mode and the second position is associated with the cross control mode as described above.

When the control mode selector switch SW8 is in the first position (current control mode), an output 164*a* of the negative error amplifier 164 is directed through the first contact SW8A to an input of a negative power supply transistor Q1, and an output 162*a* of the positive error amplifier 162 is directed through the second contact SW8B to an input of a positive power supply transistor Q2. The negative power supply transistor Q1 gates the regulated 16.5 volts DC to the input of the negative HV power supply PS10 thereby providing the modulated voltage between 0 volts DC and 12 volts DC proportional to the input voltage of the negative power supply transistor. In a similar fashion, the positive power supply transistor gates the regulated 16.5 volts DC to the input of the positive HV power supply PS20 thereby providing the modulated voltage between 0 volts DC and 12 volts DC proportion to the input voltage of the positive power supply transistor. In the current control mode, the gated output of the negative power supply transistor Q1 is directed through contact SW8D to a negative control voltage (NCV) conductor, and the gated output of the positive power supply transistor Q2 is directed through contact SW8C to a positive control voltage (PCV) conductor. The NCV and PCV conductors connect to the other circuits in FIGS. 11–15.

When the control mode selector switch SW8 is in the second position (cross control mode), the output 164*a* of the negative error amplifier 164 is directed through the first contact SW8A to the input of the positive power supply transistor Q2, and the output 162*a* of the positive error amplifier 162 is directed through the second contact SW8B to the input of the negative power supply transistor Q1. In the cross control mode, the gated output of the negative power supply transistor Q1 is directed through contact SW8D to the PCV conductor, and the gated output of the positive power supply transistor Q2 is directed through contact SW8C to the NCV conductor.

The mode selector switch SW8 may be a simple two position, dry contact type switch with a slide-type actuator, a rotary type actuator, push-to-set/push-to-reset actuator, or a toggle type actuator. Alternatively, the mode selector switch SW8 may simply pilot a relay, SCR, transistor or the like to divert four outputs. As mentioned above, it should be noted that the type of switch or its equivalent is not critical to the present invention.

The potentiometers R8, R9 of the negative error amplifier 164 and positive error amplifier 162 circuits are also tied together with a Zener diode Z and biasing resistor R52 to reference the two error amplifiers 162, 164 to each other, thereby forming a common reference REF. The common reference REF allows the control circuit 160 to achieve an output balance when relative charge conditions are relatively stable. In an alternate embodiment, the potentiometers R8, R9 are replaced with a single potentiometer, a laser trimmed resistor, a resistor bank or the like.

Figure 11:
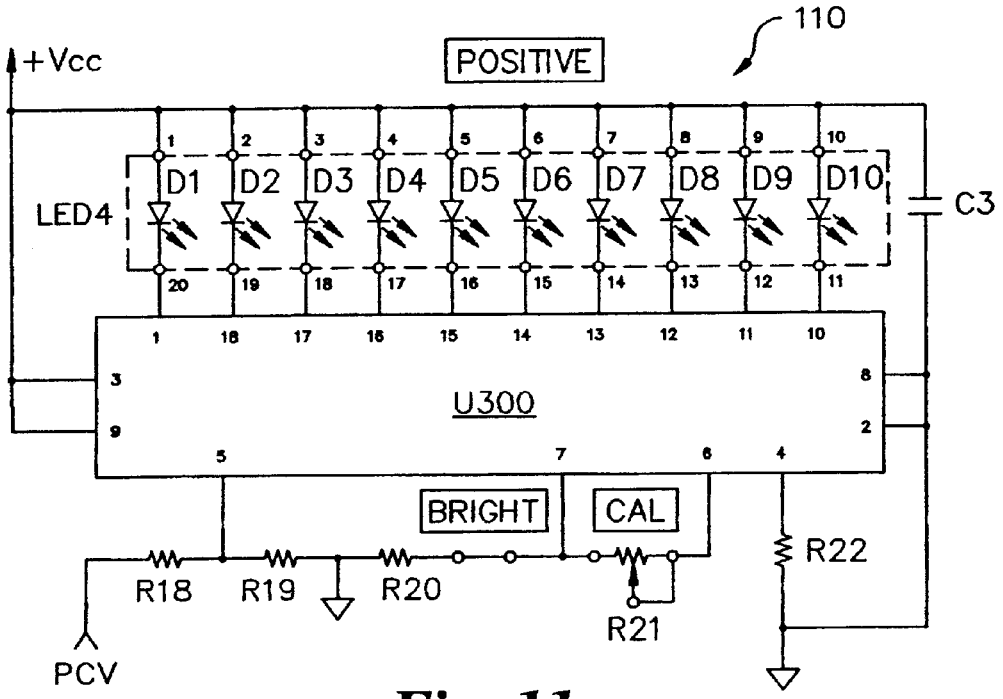
FIG. 11 is a detailed electrical schematic of a positive neutralizing current indicator for the control circuit of FIGS. 9A–9C.

FIG. 11 is a positive power supply control voltage indicator 110 circuit schematic. The PCV, in conjunction with biasing resistors R18, R19, R20, and potentiometer R21 provides inputs to a light emitting diode (LED) driver IC U3. The LED driver IC U300 is supplied with regulated 16.5 VDC, and in conjunction with suitable biasing components such as resistor R22 and capacitor C3, drives an LED array LED4. The LED array LED4 includes ten LED's that may be arranged in a bar graph configuration. Alternatively, LED array LED4 could be replaced with individual LED's, indicator lamps, gauges or the like without departing from the broad scope of the present invention.

Figure 12:
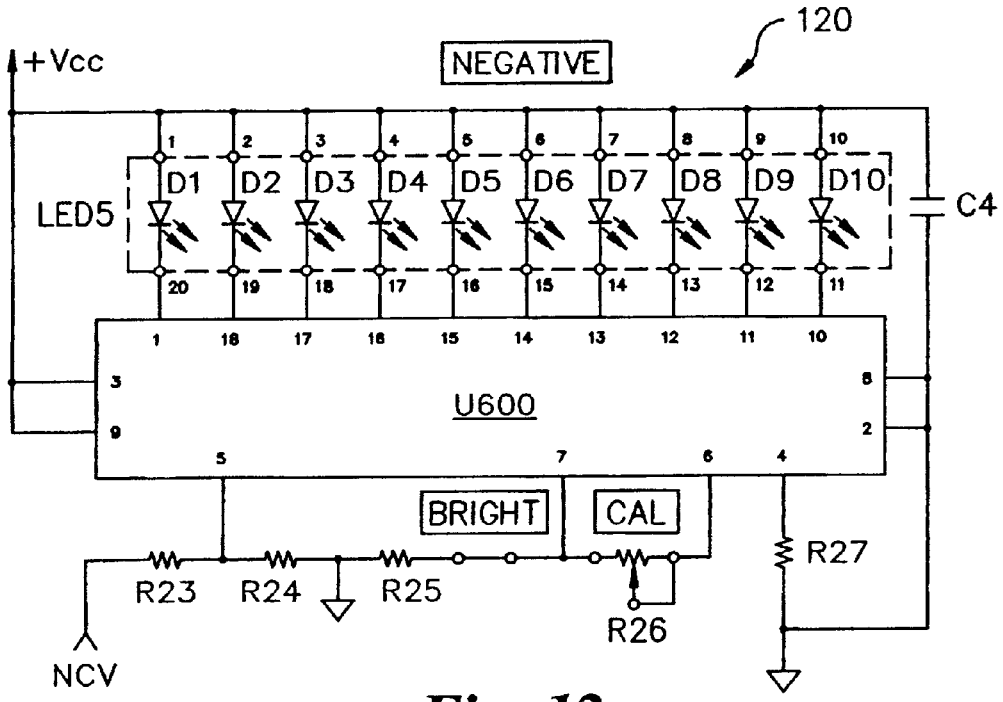
FIG. 12 is a detailed electrical schematic of a negative neutralizing current indicator for the control circuit of FIGS. 9A–9C.

FIG. 12 is a negative power supply control voltage indicator 120 circuit schematic. The NCV, in conjunction with biasing resistors R23, R24, R25, and potentiometer R26 provides inputs to a light emitting diode (LED) driver IC U6. The LED driver IC U600 is supplied with regulated 16.5 VDC, and in conjunction with suitable biasing components such as resistor R27 and capacitor C4, drives an LED array LED5. The LED array LED5 includes ten LED's that may be arranged in a bar graph configuration. Alternatively, LED array LED5 could be replaced with individual LED's, indicator lamps, gauges or the like without departing from the broad scope of the present invention.

Figure 13:
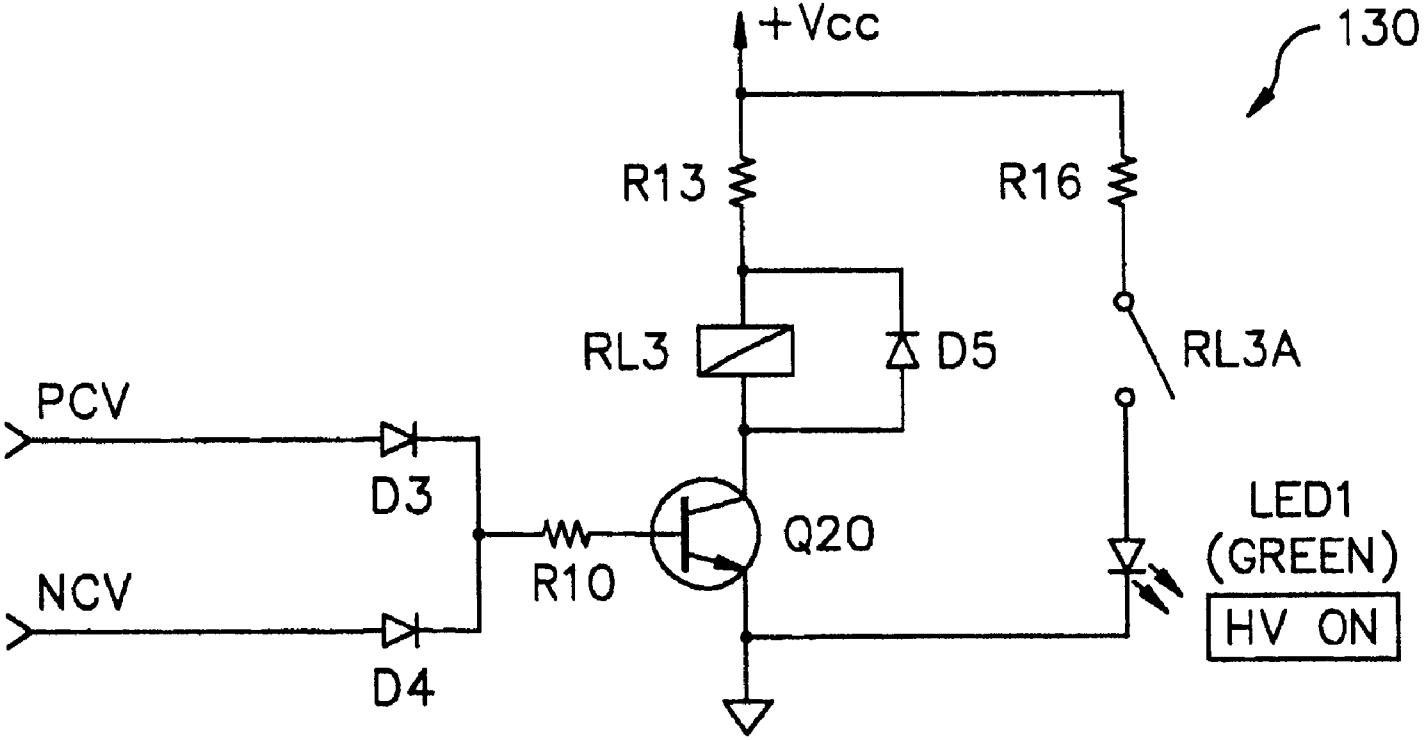
FIG. 13 is a detailed electrical schematic of a high voltage on indicator for the control circuit of FIGS. 9A–9C.

FIG. 13 is a HV-on indicator 130 circuit schematic. The PCV and NCV are directed through diodes D3 and D4, respectively. If either voltage is high (not zero), a voltage will be provided through resistor R10 to an HV on transistor Q20. The HV-on transistor Q20 drives, in conjunction with suitable biasing components such as resistor R13 and diode D5, a HV-on relay RL3 coil. A normally open contact RL3A of relay RL3 closes when the relay RL3 is energized and provides regulated 16.5 VDC biased through a resistor R16 to a preferably green LED, HV-on LED 1. Thus, when either or both PCV and NCV are high, the transistor Q2 is on, the relay RL3 is energized, the contact RL3A is closed and the LED LED1 is illuminated. The HV-on relay RL3 may also have other normally open or normally closed contacts (not shown) for providing external signals or annunciation.

Figure 14:
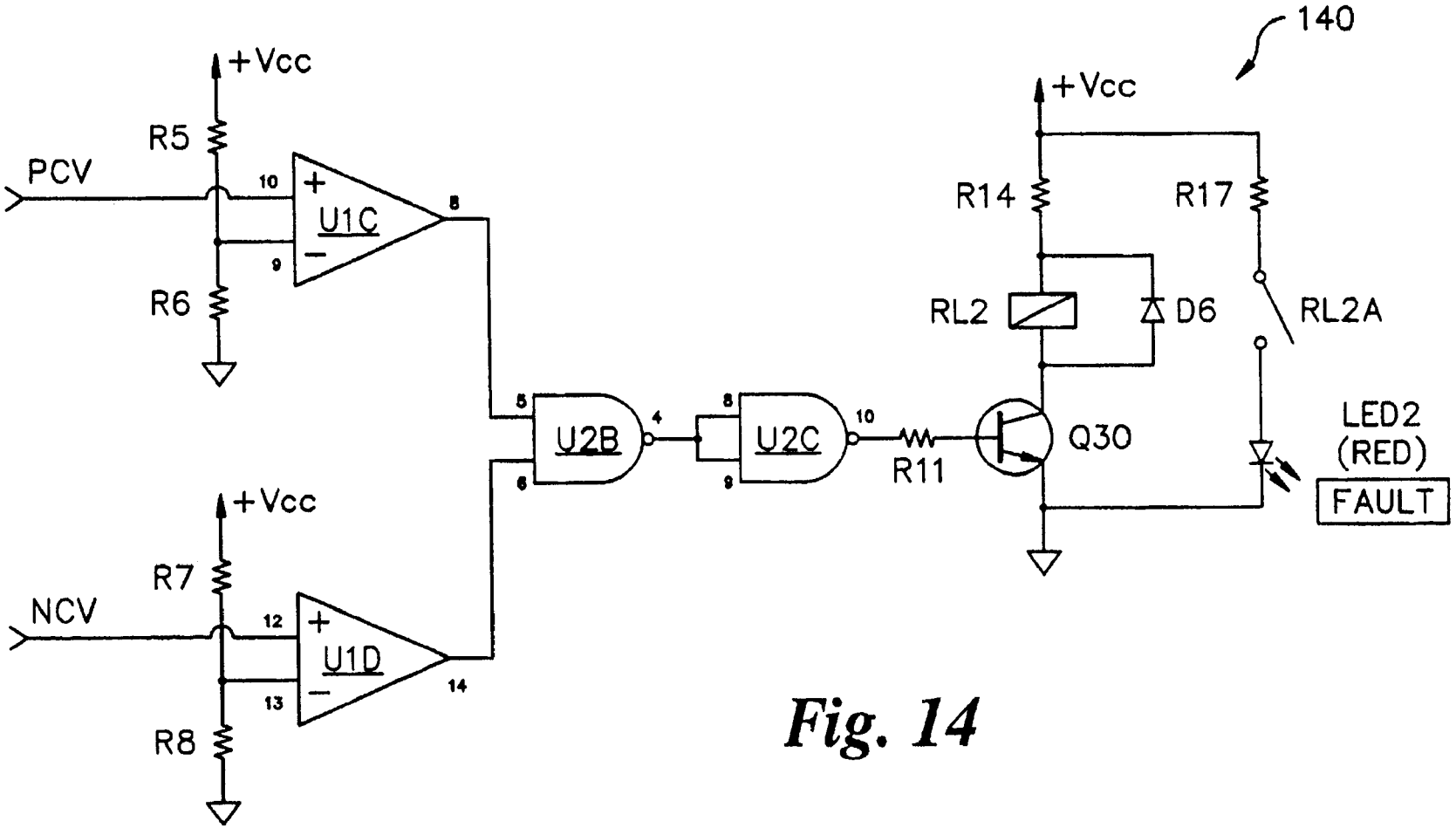
FIG. 14 is a detailed electrical schematic of a fault indicator for the control circuit of FIGS. 9A–9C.

FIG. 14 is a Fault indicator 140 circuit schematic. The PCV is connected to a PCV voltage comparator IC U1C which compares the PCV voltage level to a voltage level biased below the regulated 16.5 VDC by resistors R5 and R6. The NCV is connected to an NCV voltage comparator IC U1D which compares the NCV voltage level to a voltage level biased below the regulated 16.5 VDC by resistors R7 and R8. Outputs of the comparators U1C and U1d are gated through a first NAND gate U2B and a second NAND gate U2C which is equivalent to an AND gate. Thus, if both PCV and NCV are greater than their respective biased voltages at comparators U1C and U1D, a voltage will be provided through resistor R11 to an fault transistor Q30. The Fault transistor Q30 drives, in conjunction with suitable biasing components such as resistor R14 and diode D6, a Fault relay RL2 coil. A normally open contact RL2A of relay RL2 closes when the relay RL2 is energized and provides regulated 16.5 VDC biased through a resistor R17 to a preferably red LED, Fault LED 2. The Fault relay RL2 may also have other normally open or normally closed contacts (not shown) for providing external signals or annunciation.

Figure 15:
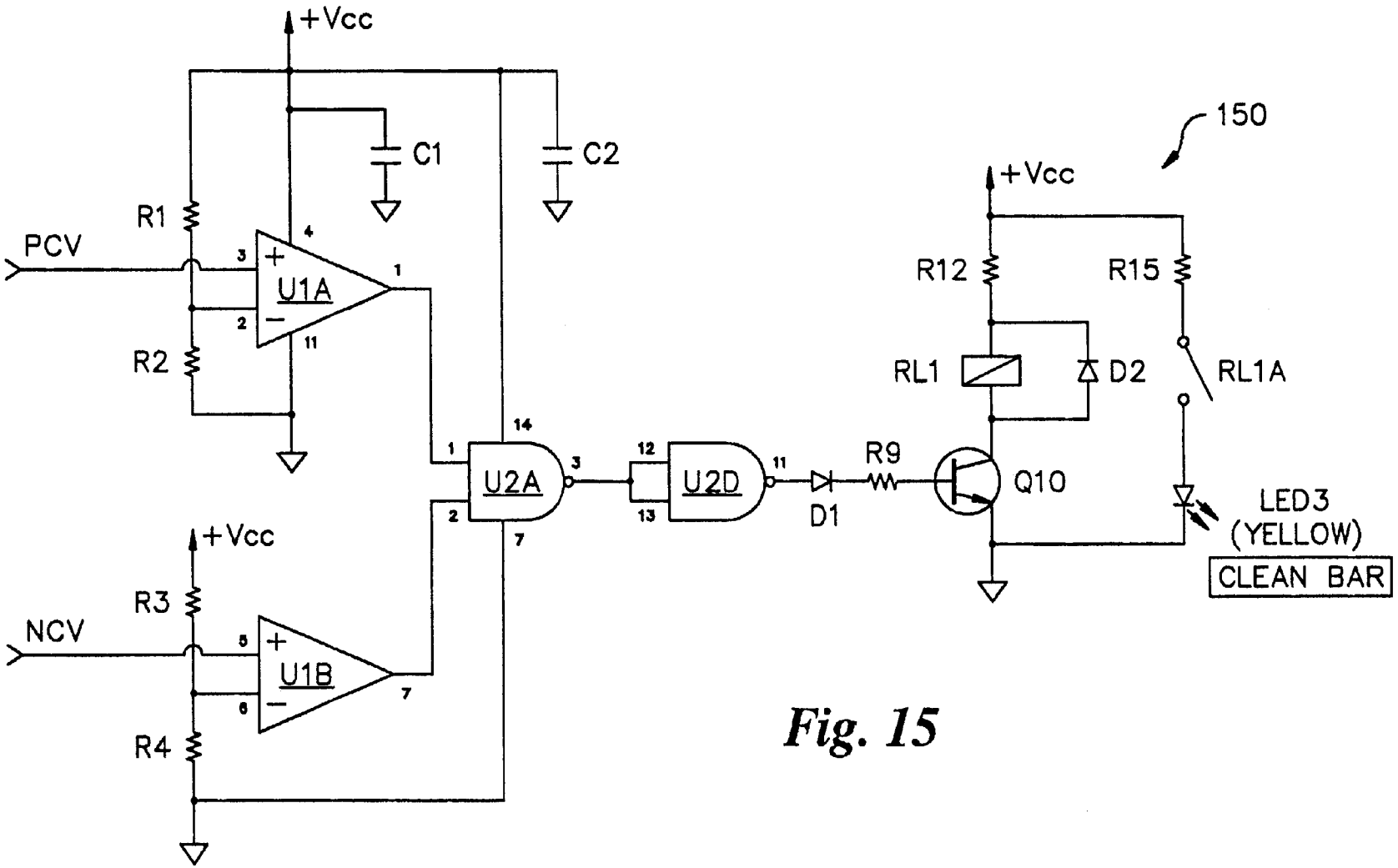
FIG. 15 is a detailed electrical schematic of a clean bar indicator for the control circuit of FIGS. 9A–9C.

FIG. 15 is a Clean-bar indicator 150 circuit schematic. The PCV is connected to a PCV voltage comparator IC U1A which compares the PCV voltage level to a voltage level biased below the regulated 16.5 VDC by resistors R1 and R2. The NCV is connected to an NCV voltage comparator IC U1B which compares the NCV voltage level to a voltage level biased below the regulated 16.5 VDC by resistors R3 and R4. Outputs of the comparators U1A and U1B are gated through a first NAND gate U2A and a second NAND gate U2D which is equivalent to an AND gate. Thus, if both PCV and NCV are greater than their respective biased voltages at comparators U1A and U1B, a voltage will be provided through diode D1 and resistor R9 to a clean-bar transistor Q10. The Clean-bar transistor Q10 drives, in conjunction with suitable biasing components such as resistor R12 and diode D2, a Clean-bar relay RL1 coil. A normally open contact RL1A of relay RL1 closes when the relay RL1 is energized and provides regulated 16.5 VDC biased through a resistor R15 to a preferably yellow LED, Clean-bar LED 3. The Clean-bar relay RL1 may also have other normally open or normally closed contacts (not shown) for providing external signals or annunciation. The clean-bar indicator circuit 150 also includes filtering capacitors C1 and C2 for the regulated power provided to comparator IC U1 and NAND gate IC U2, respectively.

From the foregoing, it can be seen that the present invention comprises a control circuit for ionizers having a positive power supply return current sense resistor and a negative power supply return current sense resistor that can bias a positive voltage DC power supply and a negative DC power supply, respectively or conversely. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A control circuit for an ionizer which controls an output of at least one of a positive voltage direct current power supply and a negative voltage direct current power supply, each being connected to at least one ionizing pin so as to cause a flow of positive and negative ions to be emitted from the ionizer and directed towards a target, wherein the control circuit comprises at least one of:

(a) a positive power supply return current sense resistor that biases the negative voltage power supply to decrease the output of the negative voltage power supply when a positive ion current detected by the positive power supply return current sense resistor increases and to increase the output of the negative voltage power supply when the positive ion current detected by the positive power supply return current sense resistor decreases, thereby creating a static-free environment at the target; or (b) a negative power supply return current sense resistor that biases the positive voltage power supply to decrease the output of the positive voltage power supply when a negative ion current detected by the negative power supply return current sense resistor increases and to increase the output of the positive voltage power supply when the negative ion current detected by the negative power supply return current sense resistor decreases, thereby creating the static-free environment at the target.

2. The control circuit according to claim 1, wherein the control circuit comprises both a positive and a negative return current sense resistor, and the control circuit controls the output of both of the positive voltage power supply and the negative voltage power supply.

3. The control circuit according to claim 1, wherein the ionizer is an ionizer bar and the positive voltage direct current power supply is connected to a plurality of ionizing pins spaced along the ionizer bar.

4. The control circuit according to claim 1, wherein the ionizer is an ionizer bar, and the negative voltage direct current power supply is connected to a plurality of ionizing pins spaced along the ionizer bar.

5. The control circuit according to claim 1 wherein the ionizer includes a positive voltage ionizer bar and a negative voltage ionizer bar, each ionizer bar having elongated housings that are mounted in parallel with each other, and the positive voltage direct current power supply is connected to a plurality of ionizing pins spaced along the positive voltage ionizer bar and the negative voltage direct current power supply is connected to a plurality of ionizing pins spaced along the negative voltage ionizer bar.

6. A control circuit for an ionizer which controls an output of at least one of a positive voltage direct current power supply and a negative voltage direct current power supply, each being connected to at least one ionizing pin so as to cause a flow of positive and negative ions to be emitted from the ionizer and directed towards a target, the control circuit having a mode selector switch and wherein the control circuit comprises at least one of:

(a) a positive power supply return current sense resistor that biases the positive voltage power supply to increase the output of the positive voltage power supply when a positive ion current detected by the positive power supply return current sense resistor decreases and to decrease the output of the positive voltage power supply when the positive ion current detected by the positive power supply return current sense resistor increases, thereby creating a static-free environment at the target when the mode selector switch is in a first position and that biases the negative voltage power supply to decrease the output of the negative voltage power supply when a positive ion current detected by the positive power supply return current sense resistor increases and to increase the output of the negative voltage power supply when the positive ion current detected by the positive power supply return current sense resistor decreases when the mode selector switch is in a second position; or (b) a negative power supply return current sense resistor that biases the negative voltage power supply to increase the output of the negative voltage power supply when a negative ion current detected by the negative power supply return current sense resistor decreases and to decrease the output of the negative voltage power supply when the negative ion current detected by the negative power supply return current sense resistor increases, thereby creating the static-free environment at the target when the mode selector switch is in the first position and that biases the positive voltage power supply to decrease the output of the positive voltage power supply when a negative ion current detected by the negative power supply return current sense resistor increases and to increase the output of the positive voltage power supply when the negative ion current detected by the negative power supply return current sense resistor decreases when the mode selector switch is in the second position.

7. The control circuit according to claim 6, wherein the control circuit comprises both a positive and a negative return current sense resistor, and the control circuit controls the output of both of the positive voltage power supply and the negative voltage power supply.

8. The control circuit according to claim 1 wherein the ionizer includes an ionizer bar, the ionizer bar having an elongated housing, and the positive voltage direct current power supply is connected to a plurality of ionizing pins spaced along the ionizer bar and the negative voltage direct current power supply is connected to another plurality of ionizing pins spaced along the ionizer bar.

* * * * *